US005803833A

United States Patent [19]

Nakamura et al.

[11] Patent Number: 5,803,833

[45] Date of Patent: Sep. 8, 1998

[54] TWO-PIECE SOLID GOLF BALL

[75] Inventors: Atsushi Nakamura; Hisashi Yamagishi, both of Chichibu, Japan

[73] Assignee: Bridgestone Sports Co., Ltd., Tokyo, Japan

[21] Appl. No.: 797,609

[22] Filed: Feb. 7, 1997

[30] Foreign Application Priority Data

Feb. 7, 1996 [JP] Japan ..... 8-045444

[51] Int. Cl.[6] ..... A63B 37/06; A63B 37/12

[52] U.S. Cl. ..... 473/377; 473/378; 273/DIG. 20

[58] Field of Search ..... 473/377, 378; 273/DIG. 20

[56] References Cited

U.S. PATENT DOCUMENTS

| | | | |
|---|---|---|---|
| 4,085,937 | 4/1978 | Schenk | 473/377 X |
| 5,033,748 | 7/1991 | Ebisuno | 473/377 |
| 5,403,010 | 4/1995 | Yabuki et al. | 473/377 X |
| 5,439,227 | 8/1995 | Egashira et al. | 473/377 X |
| 5,516,110 | 5/1996 | Yabuki et al. | 473/377 X |
| 5,562,287 | 10/1996 | Endo et al. | 473/377 X |

*Primary Examiner*—George J. Marlo
*Attorney, Agent, or Firm*—Sughrue, Mion, Zinn, Macpeak & Seas, PLLC

[57] ABSTRACT

A two-piece solid golf ball comprising a solid core and a cover has a weight of 41–44.5 grams. The solid core has such a distribution of hardness as measured by a JIS-C scale hardness meter that the hardness at 2 mm inside the core surface is at least 2° lower than the hardness at the core surface and the hardness at 4 mm inside the core surface and the hardness gradually decreases from 4 mm inside the core surface to the core center. The ball offers all-around performance satisfying trajectory, carry, feeling, durability and spin to those players who are short in hitting the ball high and far despite a relatively high head speed.

3 Claims, 1 Drawing Sheet

A: SURFACE OF CORE PREFERABLY 65-90 JIS-C HARDNESS.

B: 2mm INSIDE OF A LOWER JIS-C THAN AT A BY 2 MINIMUM AND LOWER JIS-C THAN AT C' BY 2 MINIMUM

C: 4mm INSIDE OF A

D: CENTER OF CORE

TWO-PIECE SOLID GOLF BALL

BACKGROUND OF THE INVENTION

1. Field of the Invention

This invention relates to a two-piece solid golf ball.

2. Prior Art

As the number of golf players increases in these years, the demand for golf balls with respect to their playability factors such as flight, feeling, durability and spin is diversified so as to meet the level of individual players including professional, low-handicap, average, and novice players. Nevertheless, most of advanced golf balls currently available are constructed with a focus on low-handicap players who swing at a high head speed.

Under such circumstances, those golf players who are slow in head speed, including beginner, female and senior players cannot take full advantages of the advanced balls including increased carry and pleasant feel. The reason is that the flight performance is more dependent on a head speed since a weaker force applied to the ball upon impact causes a smaller deformation to the ball.

The advanced balls are also unsatisfactory to those players who swing at a relatively high head speed, but fail to gain a long distance because of low trajectory upon shots with a driver or long iron.

Lightweight golf balls have been proposed in various versions. Such lightweight golf balls are mainly targeted for low-head speed players. Japanese Patent Application Kokai (JP-A) No. 109971/1992 proposes to impart a hardness distribution to the core at no sacrifice of feeling and durability. The ball is improved in feeling by providing a core hardness distribution determined with stress concentration taken into account while restitution is maintained. The ball is not yet adequate to those players who swing at a relatively high head speed, but fail to gain a long distance because of low trajectory.

SUMMARY OF THE INVENTION

Therefore, an object of the invention is to provide a two-piece solid golf ball which offers all-around performance satisfying such playability factors as trajectory, carry, feeling, durability and spin to those players who swing at a relatively high head speed, but fail to hit the ball high and far with a driver or long iron.

We have found that the above object can be attained by controlling the weight and core hardness distribution of a two-piece solid golf ball. (1) The ball should have a weight of 41 to 44.5 grams, which is lighter than ordinary golf balls. (2) With stress concentration taken into account, the hardness distribution of the core is adjusted such that the hardness at 2 mm inside the core surface is at least 2° lower than the hardness at the core surface and the hardness at 4 mm inside the core surface, and the hardness gradually decreases from 4 mm inside the core surface to the core center. Note that the hardness is as measured by a JIS-C scale hardness meter. Then the ball will follow a higher trajectory and gain a higher initial velocity on actual shots, traveling a longer distance. The hardness distribution of the core ensures a more pleasant feel while maintaining high restitution. If the core is formed relatively soft, then the ball presents a very soft feel. If the core is formed relatively hard, then the ball presents a pleasant feel. Consequently, if the core is formed relatively hard with the target placed on those players who can swing at a relatively high head speed, but suffer from a relatively low trajectory and a less satisfactory flight distance upon shots with a driver or long iron, the ball enables high trajectory shots with a pleasant feel. The ball is further improved in spin, feel and durability particularly when the cover has a hardness in the range of 48 to 62 on Shore D hardness scale. The present invention is predicated on these findings.

Accordingly, the present invention provides a two-piece solid golf ball comprising a solid core having a spherical surface and a cover enclosing the core, wherein the golf ball has a weight of 41 to 44.5 grams, and the solid core has such a distribution of hardness as measured by a JIS-C scale hardness meter that the hardness at 2 mm inside the core surface is at least 2° lower than the hardness at the core surface and the hardness at 4 mm inside the core surface and the hardness gradually decreases from 4 mm inside the core surface to the core center. Preferably the solid core has a hardness of 65° to 90° at the surface as measured by a JIS-C hardness meter. Also preferably the cover has a Shore D hardness of 48 to 62.

DETAILED DESCRIPTION OF THE INVENTION

Figure 1:
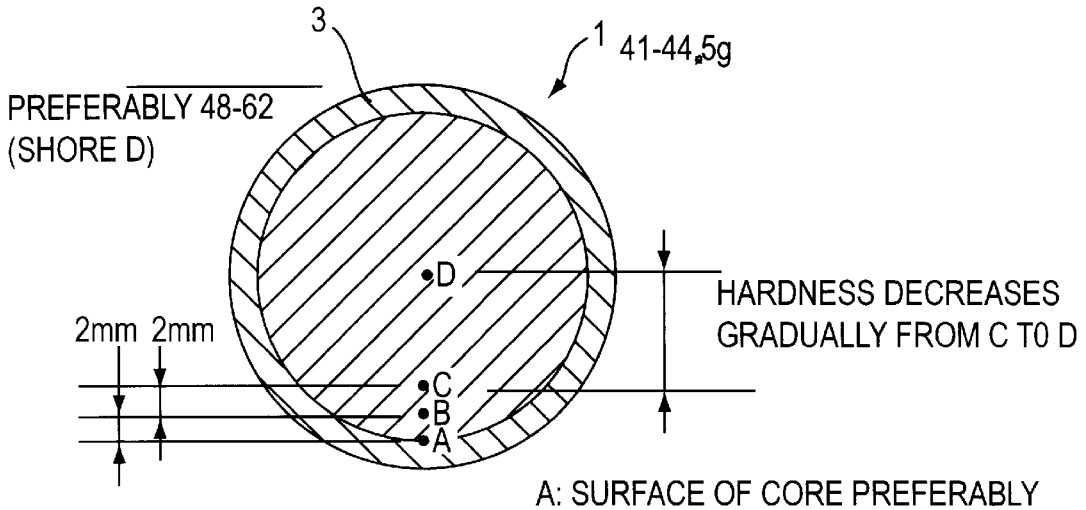
FIG. 1 illustrates the golf ball of the invention.

The present invention is directed to a 2-piece solid golf ball comprising a spherical solid core and a concentric cover. According to the invention, the ball is lightweight, that is, has a weight of 41 to 44.5 grams, preferably 42 to 44 grams. If the ball weight is less than 41 grams, the ball is too light to travel a long distance. Balls having a weight of more than 44.5 grams have no significant difference from conventional solid golf balls and fail to attain the objects of the invention.

In addition to the weight requirement, the 2-piece solid golf ball of the invention requires that the hardness distribution of the core be optimized in consideration of stress concentration. When the solid core is measured for hardness by a JIS-C scale hardness meter, the core has a hardness on its spherical surface (to be referred to as surface hardness, hereinafter), a hardness at a position located 2 mm inside the surface in a radial direction, a hardness at a position located 4 mm inside the surface in a radial direction, and a hardness at the center (to be referred to as center hardness, hereinafter). The surface hardness is an average of five measurements at arbitrary five points on the core surface.

The surface hardness should preferably be 65° to 90°, more preferably 70° to 87°, most preferably 78° to 85°. If the surface hardness of the core is less than 65°, then the core would be too soft to travel a long distance. If the surface hardness of the core is more than 90°, then the core would be too hard to present a pleasant feel.

The hardness at 2 mm inside the core surface should be at least 2°, preferably at least 5° lower than the surface hardness and the hardness at 4 mm inside the core surface. The hardness at 2 mm inside the core surface should preferably be at least 60°, more preferably at least 65° in order to avoid a loss of restitution.

Preferably the hardness at 4 mm inside the core surface should be 0° to 2° lower than the surface hardness. The hardness at 4 mm inside the core surface is approximately equal to the surface hardness and preferably ranges from 65° to 88°, especially 68° to 85°.

Further the hardness should gradually decrease from 4 mm inside the core surface to the core center. The center hardness is preferably 50° to 70°, especially 50° to 60°.

A solid core having the above-defined hardness distribution may be formed by blending a base rubber with a mixture of dicumyl peroxide and 1,1-bis-3,3,5-trimethylcyclohexane as a crosslinking agent and vulcanizing the rubber at 160° C. for 20 minutes.

The solid core as a whole should preferably have a distortion of 1.8 to 5.0 mm, especially 3.0 to 4.7 mm under a load of 100 kg. Although the diameter, weight and specific gravity are not critical, the solid core preferably has a diameter of 37.0 to 41.0 mm, especially 38.0 to 40.0 mm and a weight of 27.0 to 40.0 grams, especially 30.0 to 37.0 grams.

The solid core may be formed from conventional solid core stock materials by conventional methods while formulation and vulcanizing conditions are adjusted so as to meet the core requirement of the invention. Most often, the core is formed of a composition comprising a base rubber, a crosslinking agent, a co-crosslinking agent, and an inert filler as used in the formation of conventional solid cores. The base rubber used herein may be natural rubber and/or synthetic rubber conventionally used in solid golf balls although 1,4-polybutadiene having at least 40% of cis-structure is especially preferred in the invention. The polybutadiene may be blended with a suitable amount of natural rubber, polyisoprene rubber, styrene-butadiene rubber or the like if desired. The crosslinking agent is typically selected from organic peroxides such as dicumyl peroxide, di-t-butyl peroxide, and 1,1-bis-3,3,5-trimethylcyclohexane, with a mixture of dicumyl peroxide and 1,1-bis-3,3,5-trimethylcyclohexane being preferred. About 0.5 to 3 parts by weight of the crosslinking agent is generally blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. Examples of the inert filler include zinc oxide, barium sulfate, silica, calcium carbonate, and zinc carbonate, with zinc oxide and barium sulfate being often used. The amount of the filler blended is preferably up to about 40 parts by weight per 100 parts by weight of the base rubber although the amount largely varies with the specific gravity of the core and cover, the weight of the ball, and other factors. In the practice of the invention, the amounts of the crosslinking agent and filler (typically zinc oxide and barium sulfate) are properly selected so as to provide the desired hardness and weight to the core as a whole.

A core-forming composition is prepared by kneading the above-mentioned components in a conventional mixer such as a Banbury mixer and roll mill, and it is compression or injection molded in a core mold. The molding is then heat cured as previously mentioned, so as to produce a solid core having an optimum hardness distribution.

Next, the cover enclosing the solid core should preferably have a Shore D hardness of 48 to 62, especially 50 to 60. If the Shore D hardness of the cover is less than 48, some balls would provide insufficient restitution and feeling without click. If the Shore D hardness of the cover is more than 62, there is a risk of exacerbating spin and feeling. The gage (radial thickness) of the cover is not critical although it preferably has a gage of 1.2 to 2.5 mm, especially 1.4 to 2.3 mm.

The cover is formed of any well-known cover stock, typically based on an ionomer resin. For example, Surlyn 8220 and 8120 (E. I. duPont) and Himilan 1605, 1601, 1557, and 7315 (Mitsui duPont Polychemical K.K.) may be used alone or in admixture of two or more. Also, well-known additives such as titanium dioxide, barium sulfate, and magnesium stearate may be added to the ionomer resin for adjusting a specific gravity and hardness. UV absorbers, antioxidants and dispersing aids such as metal soaps may be added if desired. The cover stock may be molded over the solid core by any desired method, for example, by surrounding the core by a pair of preformed hemispherical cups followed by heat compression molding or by injection molding the cover stock over the core.

The thus obtained golf ball of the invention is conventionally formed with a multiplicity of dimples in the cover surface. The ball is further subject to finishing steps including buffing, painting and stamping.

While the solid golf ball of the invention is constructed as mentioned above, the diameter, initial velocity and symmetry of the ball may be properly selected in accordance with the Rules of Golf.

According to the present invention, a 2-piece solid golf ball characterized by a relatively light weight and an optimum core hardness distribution is best suited for those players who can swing at a relatively high head speed, but suffer from a relatively low trajectory and a less satisfactory flight distance upon shots with a driver or long iron, because the ball offers all-around performance satisfying trajectory, carry, feeling, durability and spin upon shots by such players.

EXAMPLE

Examples of the present invention are given below by way of illustration and not by way of limitation. All parts are by weight.

Examples 1–3 & Comparative Examples 1–2

A solid core was prepared by milling a solid core-forming rubber composition formulated as shown in Table 1 in a roll mill and vulcanizing it in a mold at 160° C. for 20 minutes in Examples 1–3 and Comparative Example 1. In Comparative Example 2, the composition was vulcanized at 120° C. for 80 minutes to produce a core having a flat hardness distribution. A cover stock formulated as shown in Table 1 was then injection molded over the solid core, obtaining 2-piece solid golf balls.

The golf balls were examined for flight performance, spin, feeling, and durability by the following tests.

Flight Test

Using a swing robot, the ball was hit with a driver (#1 W) at a head speed of 45 m/sec. (HS45) for determining a carry, total distance, and angle.

Spin

Using a swing robot, the ball was hit with a sand wedge (#SW) at a head speed of 19 m/sec. (HS19) for determining a spin rate.

Feeling Test

Five players actually hit the ball to judge the hitting feel. The rating was "◎" for a very soft feel, "O" for a soft feel, and "Δ" for a rather hard feel.

Durability

Using a flywheel hitting machine, the ball was repeatedly hit at a head speed of 38 m/sec. until it was broken. In accordance with the count of hits, the ball was rated "◎" for high durability, "O" for acceptable durability, and "X" for poor durability.

The results are shown in Table 1.

TABLE 1

| | | | E1 | E2 | E3 | CE1 | CE2 |
|---|---|---|---|---|---|---|---|
| Core composition (pbw) | | | | | | | |
| Cis-1,4-polybutadiene rubber | | | 80 | 85 | 100 | 90 | 100 |
| Polyisoprene rubber | | | 20 | 15 | — | 10 | — |
| Zinc acrylate | | | 30 | 30 | 23 | 27 | 20 |
| Zinc oxide | | | 6 | 12 | 12.5 | 25 | 14 |
| Dicumyl peroxide | | | 0.9 | 0.9 | 0.9 | 0.9 | 0.9 |
| 1,1-bis-3,3,5-trimethylcyclohexane | | | 0.3 | 0.3 | 0.3 | 0.3 | 0.3 |
| Cover composition (pbw) | | | | | | | |
| Surlyn 8220 | | | — | — | — | 50 | — |
| Himilan 7315 | | | — | — | — | 50 | — |
| Himilan 1605 | | | 50 | — | — | — | — |
| Himilan 1557 | | | 50 | 50 | 60 | — | 50 |
| Himilan 1601 | | | — | 50 | — | — | 50 |
| Surlyn 8120 | | | — | — | 40 | — | — |
| Cover hardness (Shore D) | | | 60 | 58 | 53 | 68 | 58 |
| Ball weight (g) | | | 42.5 | 44.0 | 43.3 | 45.4 | 43.3 |
| Core hardness | Surface | | 78 | 80 | 72 | 80 | 62 |
| (JIS-C) | 2 mm inside | | 73 | 78 | 66 | 78 | 62 |
| | 4 mm inside | | 77 | 80 | 72 | 80 | 62 |
| | Center | | 65 | 64 | 56 | 64 | 48 |
| Performance | #1W/HS45 | Carry (m) | 209.0 | 210.5 | 209.0 | 207.0 | 205.0 |
| | | Total (m) | 217.5 | 219.5 | 218.0 | 216.5 | 212.0 |
| | | Angle (°) | 12.3 | 12.0 | 12.2 | 11.8 | 12.2 |
| | #SW/HS19 | Spin (rpm) | 4655 | 4892 | 5715 | 3860 | 4920 |
| Feel | | | ○ | ○ | ◎ | Δ | Δ |
| Durability | | | ◎ | ○ | ○ | Δ | ○ |

In Table 1, Surlyn and Himilan are the trade names of ionomer resin commercially available from E. I. duPont and Mitsui duPont Polychemical K.K., respectively.

As seen from Table 1, the ball of Comparative Example 1 has the same core hardness distribution as the ball of Example 2, but is different in ball weight and cover Shore D hardness. The ball of Comparative Example 1 follows a relatively low trajectory and does not travel a satisfactory distance because of the heavy weight and is inferior in spin, feel and durability because of the increased hardness of the cover. The ball of Comparative Example 2 which has a soft core and a flat core hardness distribution in that the hardness remains equal at the surface, 2 mm inside the surface and 4 mm inside the surface does not travel a satisfactory distance and presents an unpleasant feel.

In contrast, the 2-piece solid golf balls having an optimum ball weight, core hardness distribution and cover hardness within the scope of the invention exhibit all-around performance since they follow a relatively high trajectory, travel a satisfactory distance and are improved in spin, feel and durability Japanese Patent Application No. 45444/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A two-piece solid golf ball comprising a solid core having a spherical surface and a cover enclosing the core, wherein the golf ball has a weight of 41 to 44.5 grams, and said solid core has such a distribution of hardness as measured by a JIS-C scale hardness meter that the hardness at 2 mm inside the core surface is at least 2° lower than the hardness at the core surface and the hardness at 4 mm inside the core surface and the hardness gradually decreases from 4 mm inside the core surface to the core center.

2. The golf ball of claim 1 wherein said solid core has a hardness of 65° to 90° at the surface as measured by a JIS-C scale hardness meter.

3. The golf ball of claim 1 wherein said cover has a Shore D hardness of 48 to 62.

* * * * *